US007124559B2

(12) United States Patent
Taylor

(10) Patent No.: US 7,124,559 B2
(45) Date of Patent: Oct. 24, 2006

(54) PACKAGING MACHINE FORMER SUPPORT

(75) Inventor: Alfred A. Taylor, Lugarno (AU)

(73) Assignee: TNA Australia Pty Limited, Lidcombe (AU)

( * ) Notice: Subject to any disclaimer, the term of this patent is extended or adjusted under 35 U.S.C. 154(b) by 26 days.

(21) Appl. No.: 10/888,071

(22) Filed: Jul. 8, 2004

(65) Prior Publication Data

US 2005/0066629 A1 Mar. 31, 2005

(30) Foreign Application Priority Data

Jul. 8, 2003 (AU) ..... 2003903509

(51) Int. Cl.
*B65B 9/20* (2006.01)

(52) U.S. Cl. ..... 53/551; 53/201

(58) Field of Classification Search ..... 53/551, 53/552; 493/302

See application file for complete search history.

(56) References Cited

U.S. PATENT DOCUMENTS 2,996,025 A * 8/1961 Vasil ..... 72/446
3,054,236 A * 9/1962 Stroop ..... 53/554
4,520,612 A * 6/1985 Muller ..... 53/48.9
5,715,656 A * 2/1998 Pearce ..... 53/451
6,131,366 A * 10/2000 Fukuda ..... 53/64
6,131,367 A * 10/2000 Fukuda et al. ..... 53/201

FOREIGN PATENT DOCUMENTS

EP 0850836 A1 7/1998
WO WO 02/066329 A1 8/2002

* cited by examiner

*Primary Examiner*—John Sipos
(74) *Attorney, Agent, or Firm*—Townsend and Townsend and Crew LLP

(57) ABSTRACT

A packaging apparatus 10 including a cabinet 11 provided with a door 12 which is movable relative to an axis opening 13. Within the cabinet 11 is a packaging machine 15 with which there is associated a former 14. The former 14 is movably supported for movement between an operative position aligned with the packaging machine 15, and a service position spaced laterally toward the access opening 13.

10 Claims, 7 Drawing Sheets

PACKAGING MACHINE FORMER SUPPORT

TECHNICAL FIELD

The present invention relates to an assembly to support a former of packaging apparatus.

BACKGROUND OF THE INVENTION

Packaging machines employ a former to transform stripped bag material into a tubular configuration into which the product to be packaged is delivered. The tubular bag material is subsequently longitudinally and transversely sealed and transversely cut to form discreet bags of product.

The formers are generally located within a cabinet provided with a door. Frequently, the former needs to be removed and replaced for servicing and other requirements, To do so, an operator much reach into the cabinet, lift the former and remove it from its "saddle".

If the former is provided with a gas supply, the operator must disconnect conduits attached to the former so that the former may be removed.

The above discussed method of removing and disconnecting the former is difficult and time consuming as the former is spaced inwardly of the cabinet from the door.

OBJECT OF THE INVENTION

It is the object of the present invention to overcome or substantially ameliorate at the above disadvantages.

SUMMARY OF THE INVENTION

There is disclosed herein a combination including a packaging machine former and a support for the former to support the former for movement relative to a packaging machine, said former including:

a former shoulder over which strip bag material is passed to be formed into tubular bag material to be delivered to the packaging machine;

said support including:

a first portion attached to the former; and a second portion be fixed with respect to the packaging machine; and wherein said first portion is movable relative to said second portion while still attached to the first portion so that the former is supported and movable between a first position aligned with the packaging machine so as to deliver the tubular bag material thereto, and a second position spaced from the first position to facilitate access to the former.

Preferably, said former when moving between the first and second positions thereof moves substantially in a horizontal plane.

Preferably, said first portion is angularly movable relative to said second portion.

Preferably, said support includes a pair of spaced arms attached to the former, with said first portion including pivot assemblies attaching the arms to the former, and said second portions including pivot assemblies attached to the arms and adapted to be fixed relative to the packaging machine so as to provide for the angular movement of the former between the first and second positions thereof.

Preferably, said first portion is linearly movable relative to said second portion so that the former is movable between said first position and said second position.

Preferably, said first portion is slidably supported by said second portion.

Preferably, said combination includes a cabinet with said packaging machine located therein, and wherein said cabinet has an access opening to provide for access to the former, with the first portion moving toward the access opening in moving from said first portion to said second portion.

Preferably, said support includes ducting extending to the former for the deliver of gas thereto.

Preferably, said former includes a chute extending to a former shoulder and through which product moves to be directed by the former so as to be received within the tubular bag material.

Preferably, said former includes ducting communicating with the ducting of said support so that said gas is delivered to said chute.

There is disclosed herein a combination including:

a cabinet having an access opening;

a packaging machine within the cabinet;

a former support within the cabinet supporting the former; and wherein on said former support; and wherein the former support provides for support and movement of the former between a first position at which the former is spaced from the access opening and aligned with the packaging machine to deliver tubular bag material thereto, and a second position spaced from the first position toward said access opening.

Preferably, the former includes a base attached to the former supports and a former shoulder mounted on the former base, with said support including a first portion including at least one member upon which the base is mounted, and a second portion that receives said first portion to provide for movement of said shoulder between the first and second positions thereof by movement of the base.

Preferably, said first portion is mounted in said second portion for sliding horizontal movement relative thereto to move the shoulder between the front and second positions thereof.

Preferably, there is a pair of support members to which the shoulder is attached.

Preferably, said shoulder is removably attached to the member or members.

Preferably, said combination includes means to releasable secure the shoulder in said first position.

Preferably, said support includes ducting for the delivery of a gas to said shoulder.

Preferably, said combination includes a chute extending to said shoulder so as to direct product to be packaged to the shoulder.

Preferably, said combination includes ducting extending from the ducting of said support to said chute to deliver the gas to said chute.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
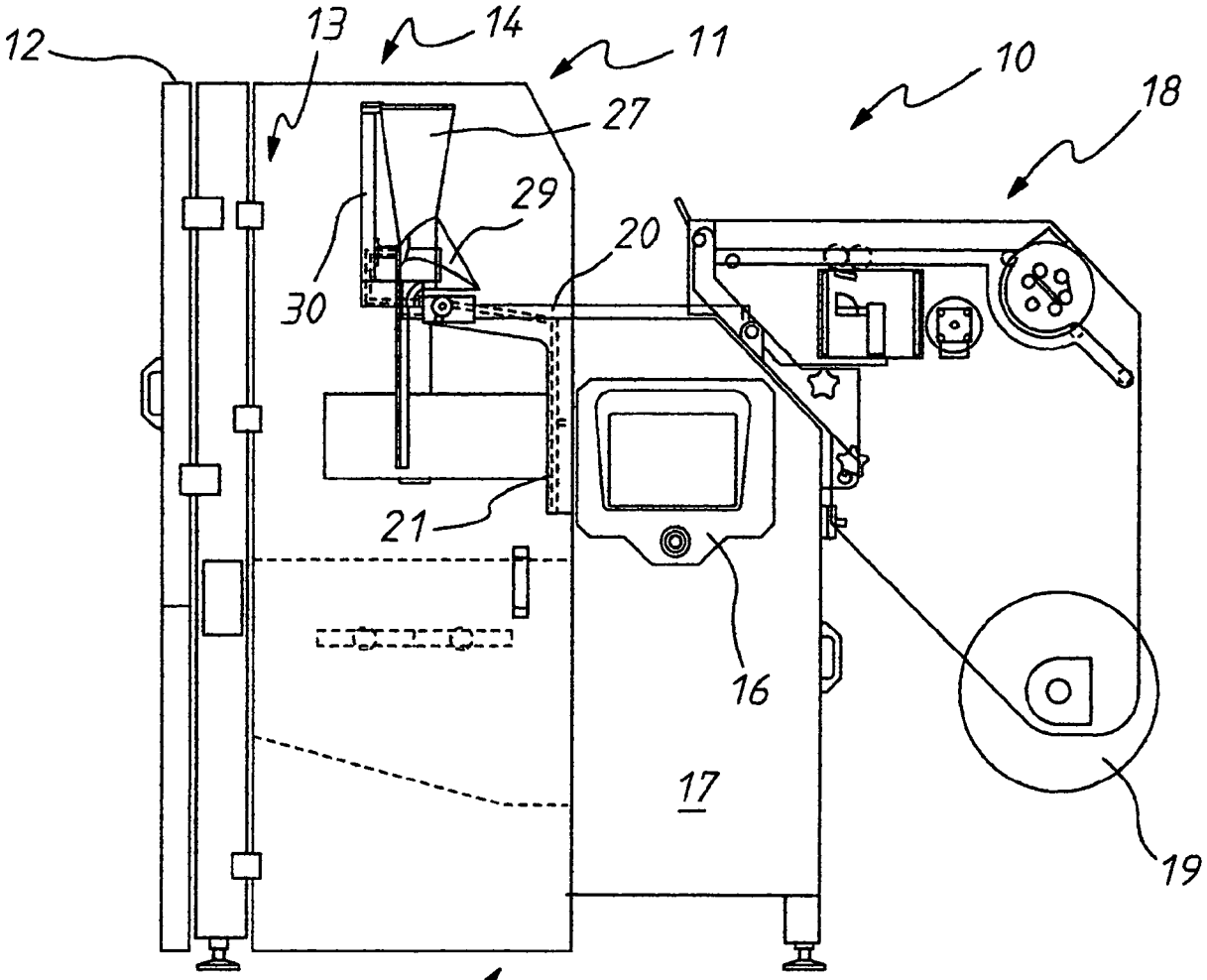
FIG. 1 is a schematic side elevation of a packaging apparatus.
Figure 2:
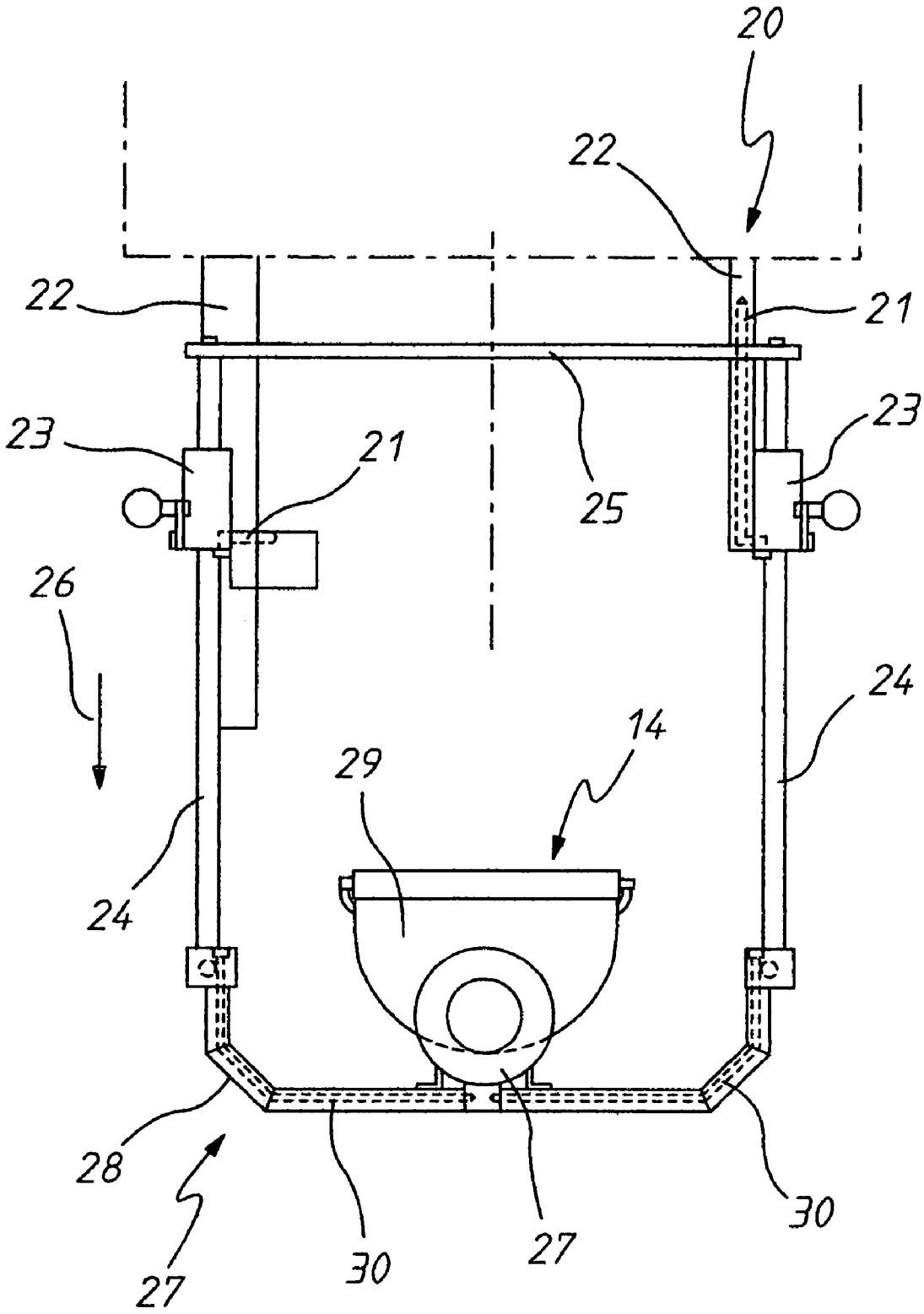
FIG. 2 is a schematic pot plan view of a former and former support employed in the apparatus of FIG. 1.
Figure 3:
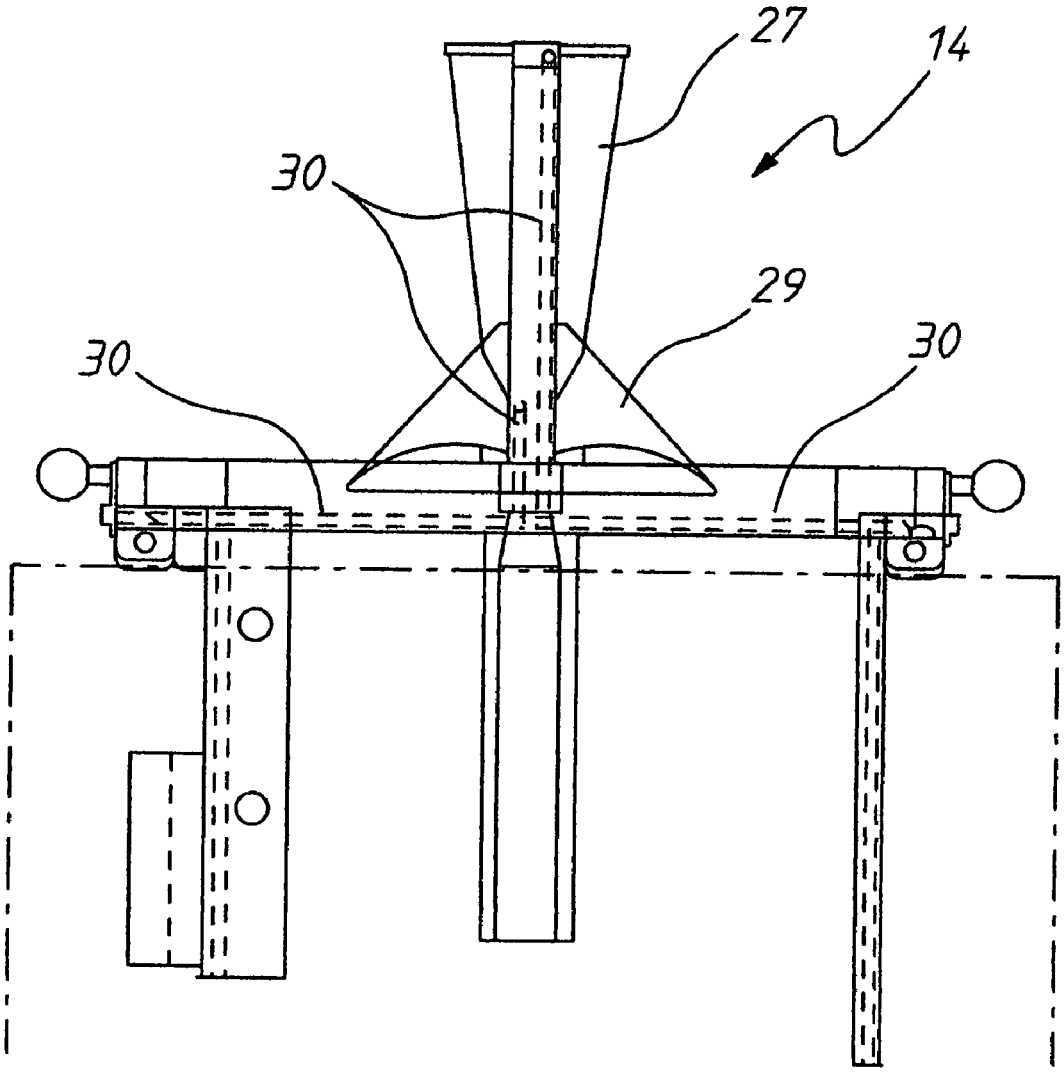
FIG. 3 is a schematic end elevation of the former and former support of FIG. 2.
Figure 4:
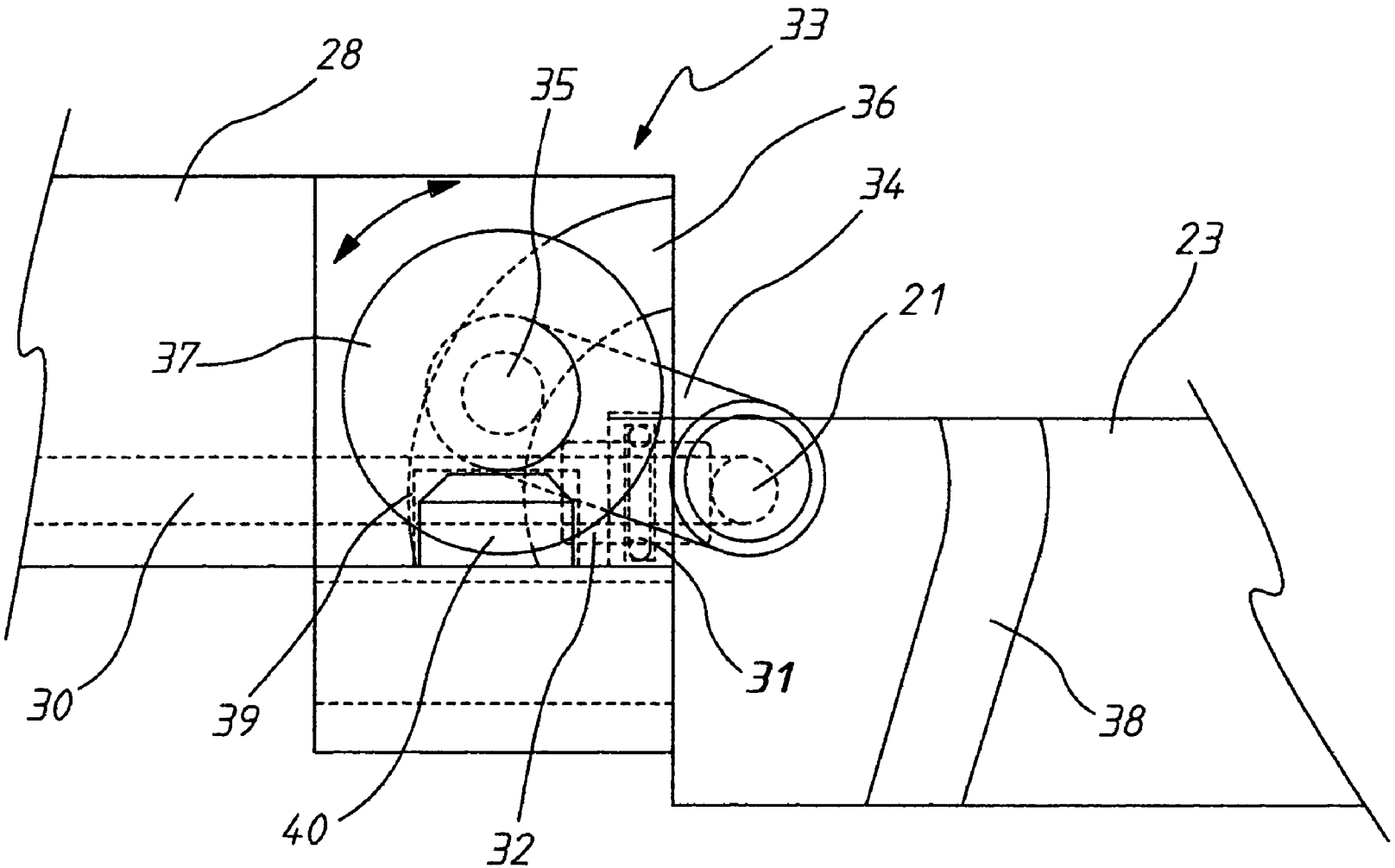
FIG. 4 is a schematic side elevation of a clamp mechanism employed in the former and former support of FIGS. 2 and 3.

In FIGS. 1 to 4 of the accompanying drawings, there is schematically depicted a packaging apparatus 10. The apparatus 10 includes a cabinet 11 including a door 12 which is movable relative to an access opening 13 between a closed and open position. In the open position, the opening 13 provides access for servicing purposes and in particular, servicing of a former 14.

Located below the former 14 is a packaging machine 15 which receives tubular bag material from the former 14 and batches of product to form discreet bags. Adjacent the cabinet 11 and machine 15 is an operator screen 16 and associated control equipment. Mounted within an enclosure 17 is the electronic control apparatus for the machine 15 and an associated web supply apparatus 18. The apparatus 18 receives a roll 19 of strip bag material, and delivers the strip to the former 14. The strip is formed into a tubular configuration for delivery to the machine 15.

Supporting the former 14 is a former support 20, the support 20 including a ducts 21 to which a supply of gas is connected. The gas is delivered to the former 14 and ultimately to the tubular bag material so that the gas is contained in the packages produced by the machine 15.

The former support 20 includes a pair of support beams 22, a pair of guides 23 attached to the beams 22, and a pair of rods 24. The guides 23 each slidably support a respective one of the rods 24 for linear sliding horizontal movement. The inner extremities of the rods 24 are attached by a link 25. The link 25 defines the limit of movement of the rods 24 in the direction of the arrow 26. The rods 24 provide a first portion of the former support 20, and the guides 23 a second portion.

Mounted on the outer extremities of the rods 24 is the former 14 including a former base 28 and a former shoulder 29 mounted on the base 28. A product chute 27 extends to the shoulder 29. The shoulder 29 receives the strip bag material from the apparatus 18 to form the bag material into a tubular configuration for delivery to the machine 15.

The base 18 includes ducting 30 that is adapted to receive the gas from one or both of the ducts 21 and to deliver the gas to the upper end of the chute 27.

Since the rods 24 are slidable within the guides 23, the former 14 is movable between the first position (FIG. 1) positioned above the machine 15 to deliver the tubular bag material and product thereto, and a second position (FIG. 2) spaced horizontally in the direction of the arrow 26 from the first position, so that the former 14 is positioned adjacent the opening 33 or beyond the periphery of the cabinet 11 so that an operator may service the former 14 or even replace the former 14.

Each of the ducts 21 terminates with a socket 31 that receives a male coupling 32 attached to the base 18. When in the first position, the male coupling 32 is engaged within socket 31 to sealingly connect the ducts 21 with the ducting 30.

To secure the former 14 in the first position thereof, there is provided a securing device 33. The device 33 in an engaging position secures the former 14 above the packaging machine 15. However, the device 33 is operable to release the former 14 for movement to its second position.

The device 33 includes an arm 34 pivotally mounted on the guide 23. The arm 34 has a pin 35 adjacent its extremity, which pin 35 is engageable within a slot 36 in the base 28. Also attached to the arm 34 is a handle 37 that an operator grips to move the pin 35 between the slot 36 and a further slot 38, the slot 38 being formed in the guide 23. Accordingly, in the position shown in FIG. 4, the pin 35 by being positioned in the slot 36 retains the former 14 in the first position thereof. However, an operator can release the former 14 for movement by moving the pin from the slot 36 to slot 38.

The former base 28 is removably attached to the extremities of the rods 24 by means of recesses 39 formed in the base 28, which recesses 39 receives projections 40 mounted on the rods 24 (adjacent to the extremities thereof). Accordingly, when the former 14 is in its second position (adjacent the opening 13), an operator can lift the former 14 from its position mounted on the rods 24 and replace it or remove it for servicing. The former 14 when remounted on the rods 24 can be moved to the first position above the machine 15.

The duct 30 may include separate duct portions which extend to separate locations in the shoulder 29.

The above described preferred embodiment has a number of advantages including easier manipulation of the former 14 for the purposes of servicing the machine 15 and the former 14. By having the former 14 located adjacent the opening 30, an operator is not required to reach deep into the cabinet 11. Still further, the former 14 is easily removed from the rods 24.

A further advantage is the automatic connection and disconnection of the gas supply to the former 14.

Figure 5:
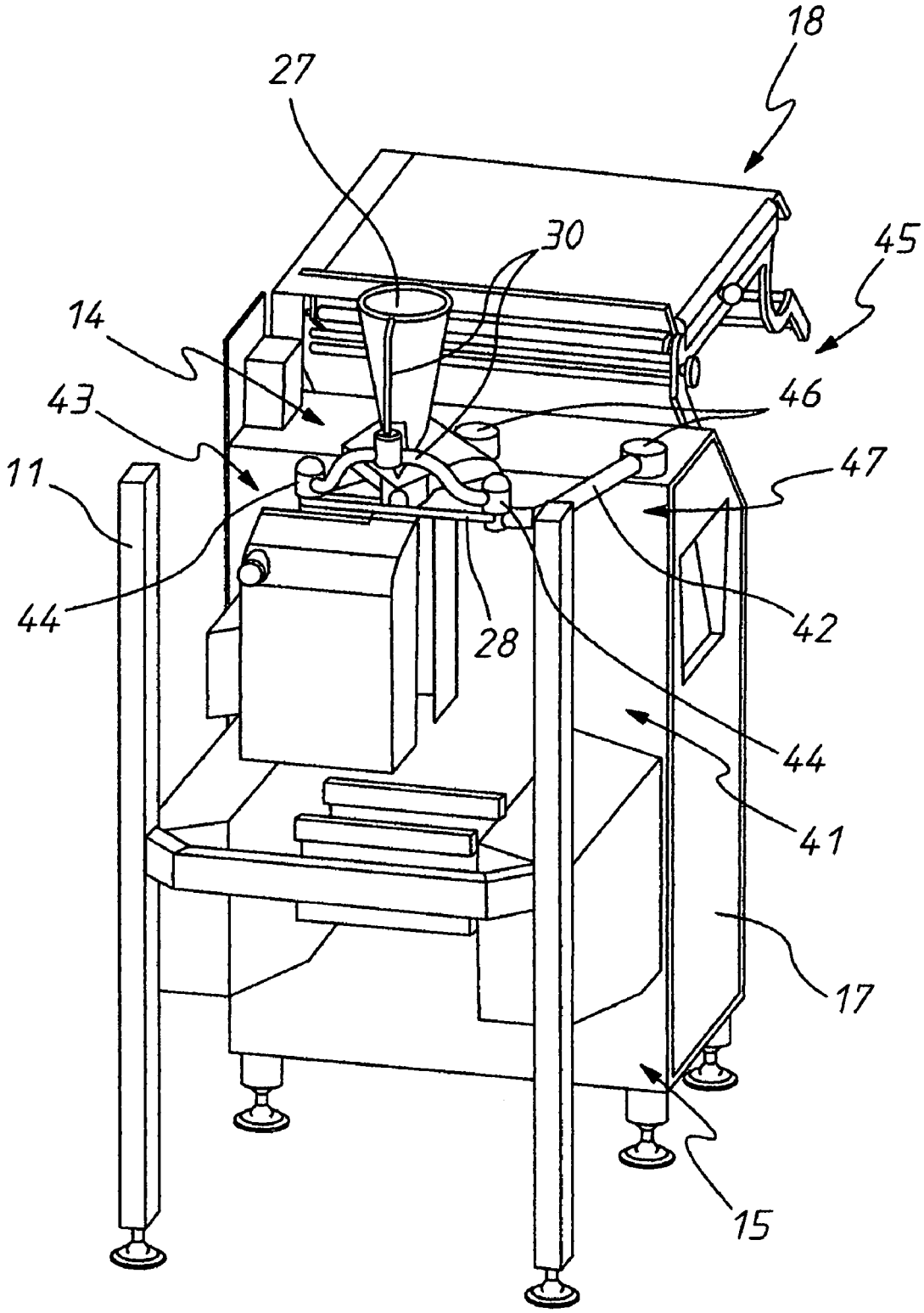
FIG. 5 is a schematic isometric view of a further packaging apparatus.
Figure 6:
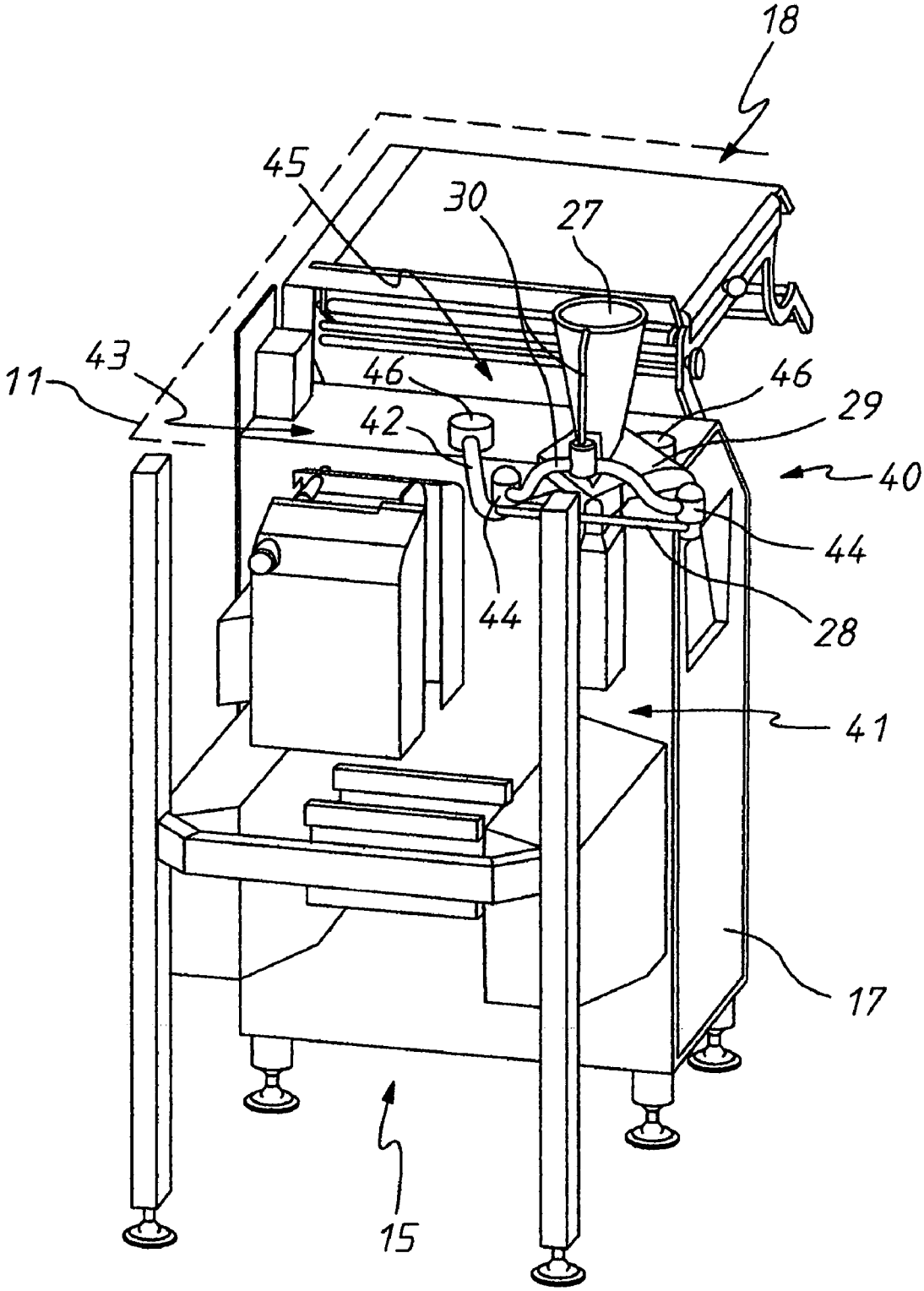
FIG. 6 is a schematic isometric view of the packaging apparatus of FIG. 5.

In FIGS. 5 and 6 of the accompanying drawings there is schematically depicted a modification of the packaging apparatus 10. In this embodiment the former 14 is supported by a former support 47 that supports the former 14 for angular movement between a first position at which the former 14 delivers tubular bag material to the machine 15 (FIG. 5), and a second position at which the former 14 is displaced laterally to facilitate access to the former 14 (FIG. 6). In this embodiment the cabinet 11 may have a front access opening 13 as illustrated in FIG. 1 or alternatively a side access opening 41 closed by a door such as the door 12 of FIG. 1.

The support 47 includes a pair of arms 42. Preferably the arms 42 are arranged in a parallel relationship and extend generally horizontally from the enclosure 17. More preferably, the arms 42 would be the same length. The support 47 includes first portions 43 in the form of a pair of pivot assemblies 44 that provide for relative pivoting movement of the arms 42 about generally vertical axes. Typically the pivot assemblies 44 would merely be a shaft extending through the arms 42 and the base 28. The support 47 includes second portions 45 in the form of pivot assemblies 46 that are attached to the arms 42 and enclosure 17 to provide for pivoting movement of the arms 42 relative to the enclosure 17 about generally vertical axes. Typically the pivot assemblies 46 would merely be a vertical shaft extending between each arm 42 and the enclosure 17. The assemblies 44 and 46 would provide generally vertical pivot axes.

The support 47 provides for angular movement of the former 14 between a first position at which it is located above the machine 15 so as to deliver the tubular bag material thereto, and a laterally displaced (second) position facilitating access to the former 14, such as an opening 13 but on a side of the cabinet 11 Typically the former 14 would move through a generally horizontal plane.

As in the previous embodiment, the former 14 includes ducting 30 to deliver a gas to the interior of the chute 27 so that the gas is delivered to the interior of the packages being formed.

As an example, the packaging machine 15 may be the machine of U.S. Pat. No. 4,663,917.

Figure 7:
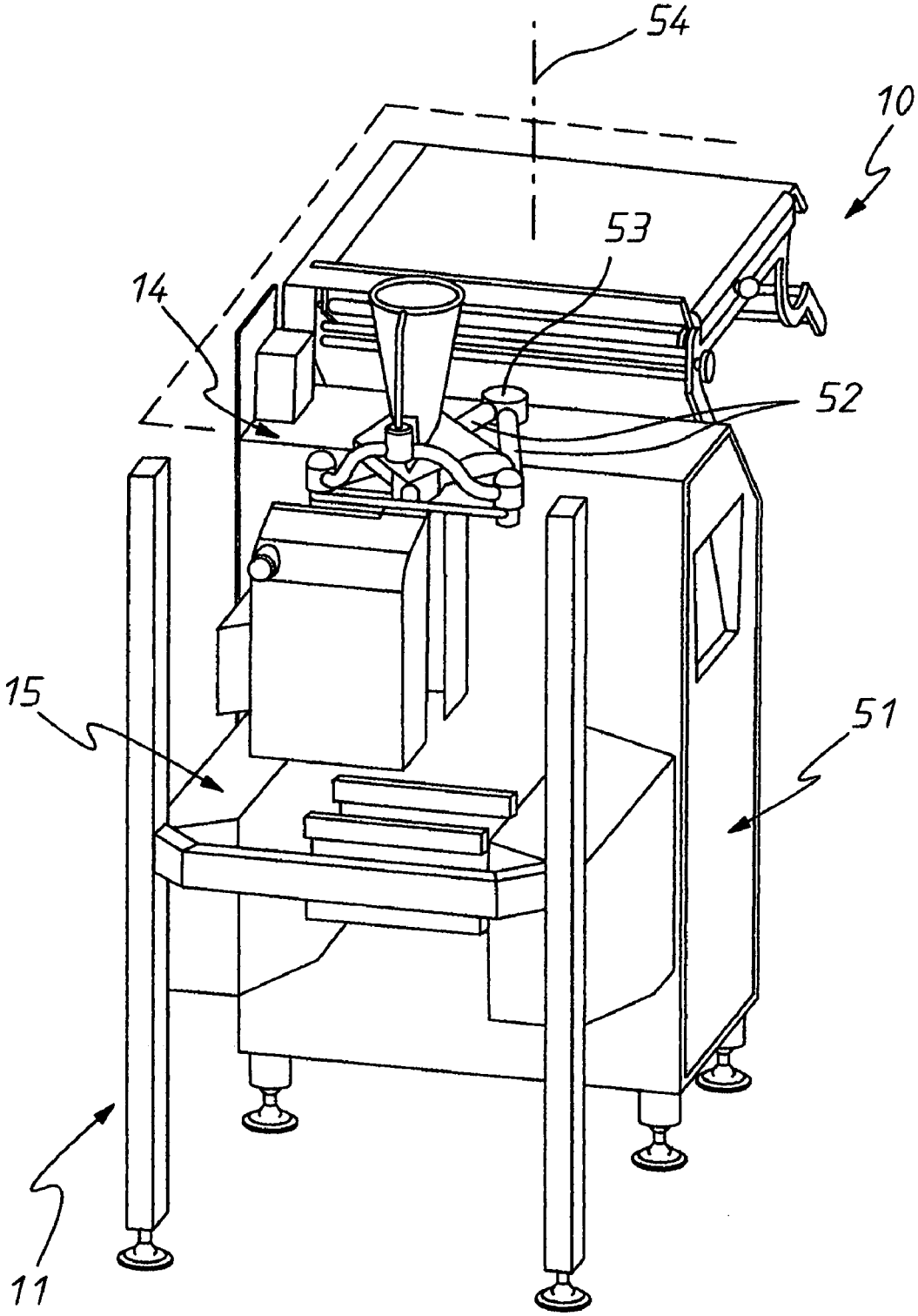
FIG. 7 is a schematic isometric view of a further packaging apparatus.

In FIG. 7 there is schematically depicted a modification of the apparatus 10 of FIGS. 5 and 6. In this embodiment a former support 50 supports the former 14 for angular movement between a first position at which the former 14 delivers tubular bag material to the machine 15, and a second position at which the former 14 is displaced laterally to facilitate access to the former 14 as previously discussed. Again in this embodiment the cabinet 11 may have a front access opening 13 as illustrated in FIG. 1 or alternatively a side access opening 51 closed by a door such as the door 12 of FIG. 1.

The support 50 includes a pair of arms 52 that are arranged so as to converge from the former 14 to a pivot assembly 53. The pivot assembly 53 provides for pivoting movement of the former 14 about a generally vertical axis 54. In this embodiment the former 14 includes the ducting 30 to deliver a gas to the interior of the chute 27 so that the gas is delivered to the interior of the packages being formed. Again the former 14 moves through a generally horizontal plane.

The invention claimed is:

1. A combination including a packaging machine former and a support for the former to support the former for movement relative to a packaging machine, said former including:

a former shoulder over which strip bag material is passed to be formed into tubular bag material to be delivered to the packaging machine;

said support including:

a first portion attached to the former; and a second portion for attachment to the packaging machine; and attached to the first portion and wherein said first portion is movable relative to said second portion while still attached to the second portion so that the former is supported by the second portion and movable between a first position aligned with the packaging machine so as to deliver the tubular bag material thereto, and a second position spaced from the first position to facilitate access to the former while said former is supported by said second portion in both positions.

2. The combination of claim 1, wherein said former when moving between the first and second positions thereof moves substantially in a horizontal plane.

3. The combination of claim 1, wherein said first portion is linearly movable relative to said second portion so that the former is movable between said first position and said second position.

4. The combination of claim 3 wherein said first portion is slidably supported by said second portion.

5. The combination of claim 1, wherein said combination includes a cabinet with said packaging machine located therein, and wherein said cabinet has an access opening to provide for access to the former, with the first portion moving toward the access opening in moving from said first portion to said second portion.

6. The combination of claim 1, wherein said support includes ducting extending to the former for the delivery of gas thereto.

7. The combination of claim 6 wherein said former includes a chute extending to a former shoulder and through which product moves to be directed by the former so as to be received within the tubular bag material.

8. The combination of claim 7 wherein said former includes ducting communicating with the ducting of said support so that said gas is delivered to said chute.

9. The combination of claim 2, wherein said first portion is angularly movable relative to said second portion.

10. The combination of claim 9, wherein said support includes a pair of spaced arms attached to the former, with said first portion including pivot assemblies attaching the arms to the former, and said second portions including pivot assemblies attached to the arms and adapted to be fixed relative to the packaging machine so as to provide for the angular movement of the former between the first and second positions thereof.

* * * * *